US006224085B1

(12) United States Patent
Cruz

(10) Patent No.: US 6,224,085 B1
(45) Date of Patent: May 1, 2001

(54) TUNNELBOARD SNOWBOARD

(76) Inventor: Mark Cruz, P.O. Box 91, Caldwell, NJ (US) 07006

( * ) Notice: Subject to any disclaimer, the term of this patent is extended or adjusted under 35 U.S.C. 154(b) by 0 days.

(21) Appl. No.: 09/480,565

(22) Filed: Jan. 10, 2000

Related U.S. Application Data

(60) Provisional application No. 60/115,479, filed on Jan. 11, 1999.

(51) Int. Cl.[7] ..... A63C 5/04

(52) U.S. Cl. ..... 280/609; 280/14.21

(58) Field of Search ..... 280/14.21, 608, 280/609, 18, 610, 14.22, 14.23, 14.24, 14.25, 14.26, 14.27, 14.28

(56) References Cited

U.S. PATENT DOCUMENTS 3,099,025 * 7/1963 Merkle et al. ..... 280/609
4,305,603 * 12/1981 Muller et al. ..... 280/609
4,974,888 * 12/1990 Morris ..... 280/609
5,018,760 * 5/1991 Remondet ..... 280/609
5,340,144 * 8/1994 Eleneke ..... 280/609
5,462,304 * 10/1995 Nyman ..... 280/609

FOREIGN PATENT DOCUMENTS

250570 * 8/1947 (CH) .

* cited by examiner

*Primary Examiner*—Richard M. Camby
(74) *Attorney, Agent, or Firm*—Bernard Murphy

(57) ABSTRACT

The novel tunnelboard snowboard is designed to offer unique and superior tracking characteristics, dampening and spring characteristics as well as providing improved turning characteristics. This new snowboard invention utilizes a new flow-through tunnel design with sharpened orthogonal protrusions imbedded therein.

3 Claims, 2 Drawing Sheets

TUNNELBOARD SNOWBOARD

This application claims benefit of provision application 60/115,479, filed Jan. 11, 1999.

BACKGROUND AND OBJECT OF THE INVENTION

This invention relates to snowboards intended for use by a single rider on a bearing surface of snow in an alpine environment. The intent of this invention is to provide a snowboard with unique and superior tracking characteristics, dampening & spring characteristics, as well as improved turning characteristics. Some of the problems of existing snowboards is their instability in a straight line, their requirement of considerable skill to turn the board proficiently, and their inability to track laterally across an incline unless they are tilted up on an outer edge. My new snowboard invention will aid the beginner and professional alike due to its improved turning and tracking characteristics.

A typical snowboard is about twelve inches wide and five to six feet in length, and has a flat bottom running surface. Most snowboards are of typical snow ski type construction and are usually one quarter to one inch thick. Usually both ends are flared upward like the tip of a snow ski. The rider's feet are held to the top of the board with straps or binding means.

Today's snowboards differ in terms of differed outer shapes; the hourglass shape is currently most popular, different tips, tails, and tops, differed dimensions, lengths, widths, and internal construction. Some designs have incorporated convex or concave curves of one means or another into their bottom surfaces, others have included additional edges other than the traditional side or perimeter edges. All snowboards have a relatively flat bottom running surface without a deviation greater than approximately one half inch.

DISCUSSION OF PRIOR ART

Prior art of the classification 280/28, 280/608, 280/609 deal with skis designed primarily to support machinery and similar heavy loads. These skis and their technology are not suited for snowboard designs. These skis have to be very strong and have to be primarily rigid with no torsional or lateral flex such as Metheny discloses in U.S. Pat. No. 5,040,818. They also have limited longitudinal flex, usually at best offering a flexible or adjustable tip. Due to the strength requirements they are typically constructed of steel or heavy alloys with distinctly different top and bottom surfaces. Most top surfaces are designed to add strength and rigidity to the bottom running surface. Some designs include the incorporation of a polymer strip or similar composite gliding surface to the lower running surface but none of them are constructed from a majority of lightweight flexible materials.

A snowboard needs to be lightweight, low profile, have sharp edges at least around its perimeter, and it needs to be flexible at least longitudinally.

Snow skis are the closest to snowboards in terms of design and function. Schmidt U.S. Pat. No. 3,503,621 is a good example of typical snow ski design. He disclosed in 1970 a ski having an hourglass shape with a substantially flat running surface. This running surface has steel edges around its perimeter and shows a small flat topped longitudinal groove in the running surface. His ski is also arcuate in a concave means as viewed from the side whereby the middle portion of the ski is elevated in relation to the tip and tail. Channels have been referenced many times since then. Muller, U.S. Pat. No. 4,305,603 in 1981 showed us a snowboard design with a flat top channel in a convex bottom running surface that widens outwardly from the central flat running surface to the elevated tail section. He also adds downwardly protruding side walls and a skeg, similar to a surfboard skeg or to a keel on a boat. Gaur U.S. Pat. No. 4,705,291 in 1987 alters the lower running surface and employs a smooth convex running surface. Morris U.S. Pat. No. 4,974,868 in 1990 claims a convex running surface as well, but adds longitudinal concave ridges formed into it and downwardly extending side walls. Methany U.S. Pat. No. 5,040,818 in 1991 shows multiple longitudinal concave surfaces mated at differing heights to form a running surface. Issued in 1992, Crocket U.S. Pat. No. 4,340,241 claims a channel that has open areas between the top and bottom surfaces and is formed by joining two runners together. Simmons, issued in 1998 describes a water ski that has a front tip portion, the bottom of which is slightly concave. His flat bottom running surface has side portions that extend in a downward means to create a channel that runs less than 50% of the longitudinal length. My invention forms a continues large concave tunnel under the snowboard running 100% of the longitudinally length of said ski or snowboard without any side portions that extend below the running surface.

Multiple edges were another means introduced to help the turning and stability characteristics of the snowboard. Remondet U.S. Pat. No. 5,018,760 in 1991 placed a second set of edges inside of the commonly claimed side or perimeter edges. He also lowered the central flat running surface (between the new inner edges) so it is stepped down from the perimeter edges and/or their adjacent running surfaces. Multiple edges were again utilized in the advancement from Harper, titled: "Multi-edged downhill snow skis" U.S. Pat. No. 5,303,949 in 1994. His primary advancement was to incorporate his second set of edges in to the side-wall portions of his ski as opposed to the bottom of the ski. This patent further refines the two edged, lowered flat central running surface. This running surface forms an overall generally convex shape. Finally, Vance's double edged snowboard U.S. Pat. No. 5,871,224 issued in February 1999 again combines the use of outer edges, inner edges, and a "laterally substantially flat" stepped down "central running surface" that is lined by edges and thus forms an overall convex lower running surface very similar to Remondets. His lowered flat central running surface is approximately half the height Remondet claims. He also claims varying angles of his inner edges in relation to the outer edges. As of this writing, the most recent issuance related to snowboards are Busby's snowboard U.S. Pat. No. 5,954,356 issued Sep. 21, 1999 that disclosed a stiffener designed to re-inforce the top surface of a snowboard and DeVille. DeVille U.S. Pat. No. 5,988,668 was issued on Nov. 23, 1999 and focuses on longitudinal reinforcements of a snowboard.

My new invention significantly differs form prior art in several means. The entire structure of my snowboard is designed to form an exaggerated concave platform who's peak tunnel height is two to three inches. The ideal thickness of the snowboard is less than one half inch. This results in a thin molded board that forms a smooth concave "tunnel" running from the front to the rear of the board. This tunnel has longitudinal sharp hardened edges or orthogonal protrusions in it. These characteristics are important to the function and flex characteristics of the snowboard.

SUMMARY OF THE INVENTION

The present invention currently named a Tunnelboard Snowboard is a snowboard designed for use on the snow in down hill environments such as a ski mountain. The rider is held to the top surface of the board through fixed or releasable binding means not considered part of this invention. The snowboard is composed of either wood, polyester or epoxy resins, with either carbon fibers, fiberglass, kevlar, or nomex fibers, or a combination thereof.

The unique novelty of my invention includes: The longitudinal concave tunnel, the presence and placement of the inner tunnel edges, the tapered parabolic shape, and the composite construction. These attributes give it unique straight-line stability, lightweight, and unique flex characteristics. It is designed to be a snowboard with new and higher performance than existing art.

The benefits of the unique "edged" concave tunnel, that runs from front to rear in the bottom running surface of the board are many. The board forms a concave tunnel with flared flat ends. The unique dimensions and construction make the snowboard much easier to control at low speed, high speed, and when landing from aerial maneuvers.

One of the reasons for the improved tracking is because the inner tunnel creates a large channel of snow (who's mass is much greater than the board itself) running through the middle of the board. This tunnel has sharpened edges or orthogonal protrusions in its radii that help the tracking characteristics and contribute to the holding power of the tunnel. This inherently holds the board on its forward course and helps to keep it from wandering or straying from side to side.

For instance, if you were to traverse a ski slope on a typical flat bottom snowboard, the board would want to slide straight down the mountain and not across it. To make it go across you must tilt the board up on one edge, at the proper angle, by leaning toward the mountain. This requires accomplished skill. Traversing the same slope with my new tunnelboard snowboard offers improved performance; the tunnel and its edges would grip and hold the snow, so there would be no need to tilt the board up on one edge. A simple weight transfer would allow the tunnel and edges to grip. Much less skill is involved.

At high speeds, in a straight line, typical flat bottom snowboards wander from side to side and are unstable. It is easy to catch an edge and fall. My tunnelboard snowboard forms the snow in a large channel as it passes through the tunnel and holds it with its edges. It inherently tracks in a straight line.

Most professional snowboard jumpers fall on the landings because they land at high speeds at less than perfect angles. The flat bottom surface of their snowboard washes out upon landing. It literally slips out from under them. The flat bottom structure of today's snowboards offer no dampening or cushioning for the rider, adding to the harsh impact of the landings. My snowboard would land on the tunnel and its edges, tracking immediately and offering additional grip. My snowboard is a one-piece unit molded to form a tunnel. This tunnel flexes and offers spring. The tunnel structure of the board by design is a factor in the longitudinal strength and flex of the board. This spring is a key feature since it can be utilized to dampen or absorb shock on landings. It can also be used as a spring to increase launch velocity when the rider is performing aerial launches. These are only some of the benefits of my new invention.

BRIEF DESCRIPTION OF THE DRAWINGS

Further objects of this invention, as well as the novel features thereof will become apparent by reference to the following text taken in conjunction with the following figures, in which.

DETAILED DESCRIPTION OF THE INVENTION

Figure 1:
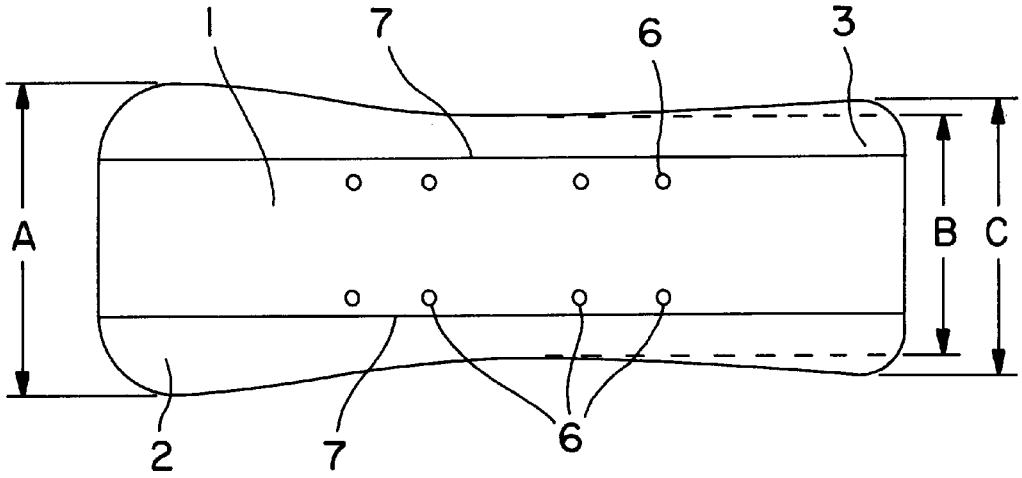
FIG. 1 is top plan view of the Tunnelboard Snowboard.
Figure 2:
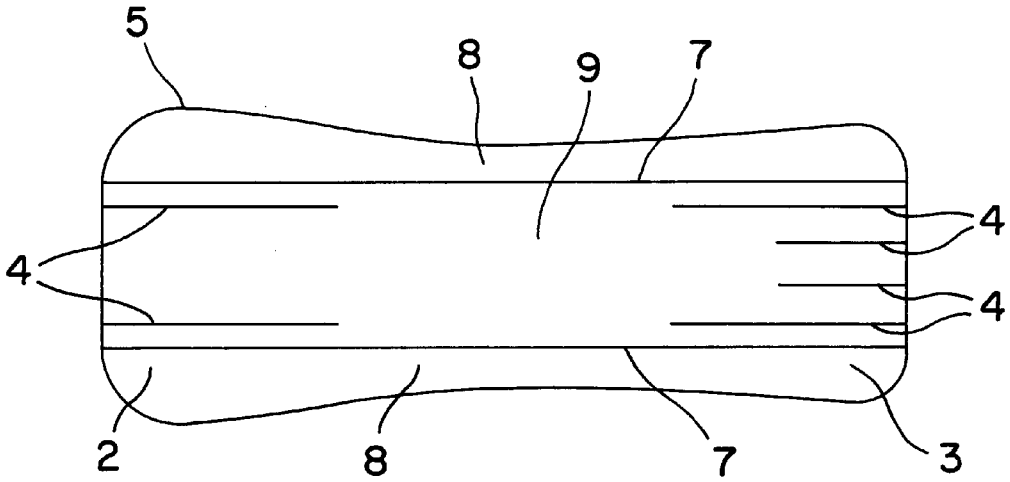
FIG. 2 is a bottom plan view of the Tunnelboard shown in FIG. 1.

As shown in FIGS. 1 and 2, the tunnelboard snowboard has a top surface 1 and a bottom surface 8 & 9. As seen from the top or bottom view, the board has a general tapered parabolic or hourglass shape (FIG. 1, dimension a, relative to c, relative to b) with the center dimension b being narrower than end dimensions a and c. One end 2, dimension a, is slightly wider than the other end 3, dimension c.

Figure 4:
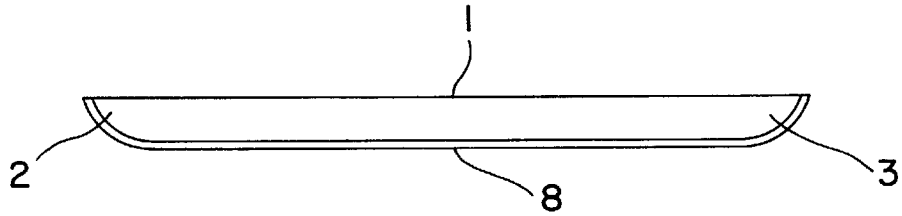
FIG. 4 is a side view of the Tunnelboard showing the upwardly curved ends.

The length of the tunnelboard may vary and may be as short as twelve inches. The described embodiment is approximately five feet in length and one quarter of one inch of thickness. The board is approximately twelve inches wide at one end 2, dimension a; ten inches wide in the center, dimension c. As shown in FIG. 4, both ends 2 & 3, are curved upward like the tip of a typical snow ski.

Figure 3:
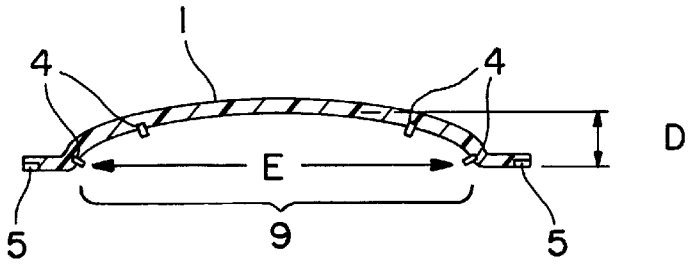
FIG. 3 is a cross sectional view of the Tunnelboard shown in FIG. 1.
Figure 5:
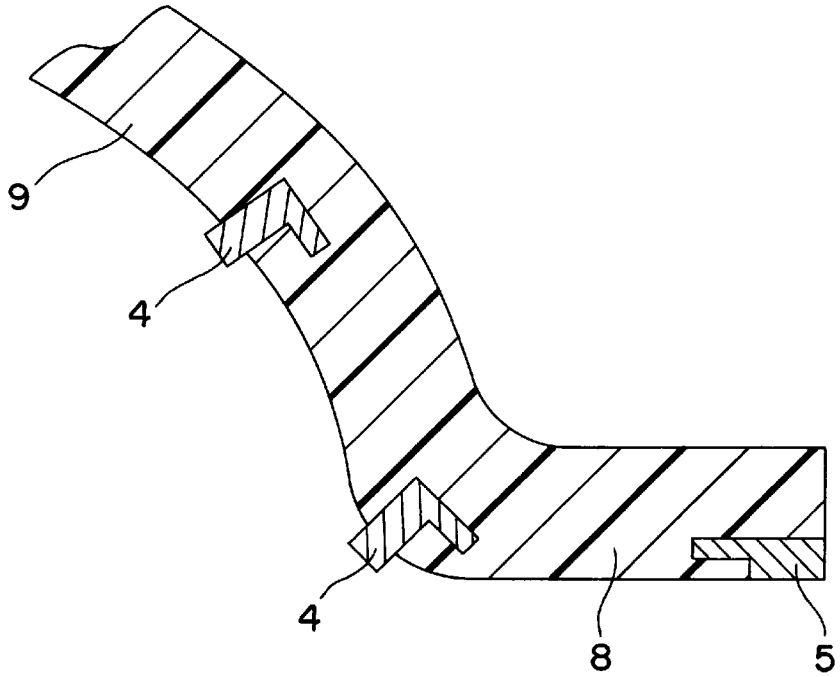
FIG. 5 is an enlarged sectional view showing the imbedded edges/orthogonal protrusions.

As depicted in the cross section of FIG. 3, while looking at the board from the front or rear (lengthwise) there is a concave tunnel 9, that runs from one end 2, to the other end 3, FIGS. 2 & 4. In FIGS. 1 and 2 the edges of the tunnel are depicted by line 7 where they transition to flat sides. The peak height of the tunnel dimension d, is approximately two inches, and the width of the tunnel 9, dimension e, is approximately eight inches. As seen in FIG. 2, the edges 4, in the tunnel 9 are parallel. FIG. 5 is an enlarged view showing the tunnel edges or orthogonal protrusions imbedded in the bottom running surface of the board and the radius that transitions to the flat sides 8.

These given rough proportions would translate to smaller or larger versions. These given descriptions in no means are meant to limit the snowboard or the snowboard's tunnel's exact dimensions or proportions but are simply to establish reference for the described embodiment. It is understood that the tunnel edges might be tapered, instead of parallel, with one end of the tunnel being narrower than the other.

For descriptive purposes, if the board were resting on a flat piece of glass, bottom side down, the two bottom outer running surfaces 8, on either side of the tunnel 9, would be in contact with the glass.

The inner edges 4, of the running surfaces 8 & 9 may be of varying length. They run from one end 2, to the other end 3, of the board. As shown in FIG. 5, the outer edge 5 of the board follows the parabolic shape.

As seen in FIGS. 2, 3 and 5, the outer edge 5, around the perimeter of the board, is a sharp edge. This edge is either a traditional steel snow ski edge or is a ground composite edge. Additional sharp edges or orthogonal protrusions 4 as shown in FIGS. 2, 3 and 5 are incorporated along portions of, or all of, the radius of the inner tunnel 9, where they meet the flatter outer running surfaces 8, of the bottom of the board.

Shown in FIG. 1, means for mounting bindings to hold the rider's feet to the top surface of the board consists of metal inserted receivers 6.

Although not shown, cross members could also be affixed on the top of the board, spanning from one side of the board to the other, fastened to additional receivers 6. The linking of one side of the board with the other will induce a change in the torsional flex characteristics of the board.

I claim:

1. A snowboard, for supporting thereon a rider, comprising:

an elongated platform formed from at least ninety-five percent non-metal material; wherein said material renders said platform flexible longitudinally, laterally, and torsionally; and said platform having a given length, and a varying width; wherein, said given length is greater than a greatest width of said varying width by more than fifty percent;

said platform has an upper surface for mounting thereon the shoes of a rider, and a bottom surface for engaging a bearing surface;

said upper and bottom surfaces have (a) arcuate conformations, and (b) flat lands; and said arcuate conformations and said lands cooperatively define edges which cause said snowboard to track in substantially linear travel;

said arcuate conformation of said bottom surface defines a tunnel; and said tunnel comprises means for forming snow, with which it engages, into an extended bead which gives said snowboard lateral stability; and said tunnel has a plurality of hardened orthogonal protrusions imbedded therein.

2. A snowboard, according to claim 1, wherein:

opposite longitudinal ends of said platform are flat; and said upper and bottom surfaces of said platform have said arcuate conformations fairing into said flat ends.

3. A snowboard, according to claim 1, wherein:

said edges are hardened.

* * * * *